US009982529B2

(12) United States Patent
Jantz et al.

(10) Patent No.: US 9,982,529 B2
(45) Date of Patent: May 29, 2018

(54) COMMUNICATION SYSTEM FOR TRANSMITTING INFORMATION VIA DRILLING RODS

(75) Inventors: Peter Jantz, Attendorn (DE); Klaus Hartmann, Wilnsdorf (DE); Wolf-Henning Twelsiek, Wilnsdorf (DE)

(73) Assignee: UNIVERSITAET SIEGEN, Siegen (DE)

( * ) Notice: Subject to any disclaimer, the term of this patent is extended or adjusted under 35 U.S.C. 154(b) by 582 days.

(21) Appl. No.: 13/640,739

(22) PCT Filed: Apr. 12, 2011

(86) PCT No.: PCT/EP2011/001826

§ 371 (c)(1),
(2), (4) Date: Oct. 12, 2012

(87) PCT Pub. No.: WO2011/128068

PCT Pub. Date: Oct. 20, 2011

(65) Prior Publication Data

US 2013/0027216 A1 Jan. 31, 2013

(30) Foreign Application Priority Data

Apr. 12, 2010 (DE) ..... 10 2010 014 706
Oct. 8, 2010 (DE) ..... 10 2010 047 568

(51) Int. Cl.
*E21B 17/00* (2006.01)
*E21B 47/12* (2012.01)
*E21B 17/02* (2006.01)

(52) U.S. Cl.
CPC ..... *E21B 47/122* (2013.01); *E21B 17/028* (2013.01)

(58) Field of Classification Search
CPC ..... E21B 47/122; E21B 47/024
(Continued)

(56) References Cited

U.S. PATENT DOCUMENTS 3,879,097 A 4/1975 Oertle
4,800,385 A 1/1989 Yamazaki
(Continued)

FOREIGN PATENT DOCUMENTS

DE 24 50 880 A1 7/1975
DE 39 16 704 A1 12/1989
(Continued)

*Primary Examiner* — Firmin Backer
*Assistant Examiner* — Munear Akki
(74) *Attorney, Agent, or Firm* — Norman B. Thot

(57) ABSTRACT

A communication system for transmitting information via drilling rod linkages includes a drill drive, drilling rod linkages comprising a first drilling rod linkage and at least one second drilling rod linkage. The first drilling rod linkage comprises an electrical line, an upper end and a lower end which comprises a receptacle for a drill head. The second drilling rod linkage comprises at least one electrical line, an upper end and a lower end. A sensor and/or actuator is arranged at the lower end of the first drilling rod linkage and at the drill head and transmits data. A first communication unit and an electronics unit are arranged at a drive end. A further communication unit is arranged at the upper end of the first drilling rod linkage and at the upper and lower ends of the second drilling rod linkage. The first communication unit and the further communication units are radio modules which transmit/receive data.

37 Claims, 6 Drawing Sheets

(58) Field of Classification Search
USPC ..... 340/854.4, 853.7, 853.1, 855.8; 175/24, 175/40
See application file for complete search history.

(56) References Cited

U.S. PATENT DOCUMENTS

| | | | | |
|---|---|---|---|---|
| 5,144,298 | A | 9/1992 | Henneuse | |
| 5,347,859 | A | 9/1994 | Henneuse et al. | |
| 5,540,280 | A | 7/1996 | Schultz et al. | |
| 5,721,538 | A * | 2/1998 | Tubel | E21B 34/066 340/853.1 |
| 6,445,307 | B1 | 9/2002 | Rassi et al. | |
| 7,040,415 | B2 | 5/2006 | Boyle et al. | |
| 7,159,654 | B2 | 1/2007 | Ellison et al. | |
| 2002/0080682 | A1 | 6/2002 | Meehan | |
| 2002/0105334 | A1 | 8/2002 | Aiello | |
| 2002/0112852 | A1 | 8/2002 | Floerke et al. | |
| 2002/0113716 | A1 * | 8/2002 | Aiello | E21B 17/003 340/853.1 |
| 2004/0079525 | A1 | 4/2004 | Boyadjieff | |
| 2005/0024231 | A1 | 2/2005 | Fincher et al. | |
| 2005/0055162 | A1 * | 3/2005 | Gao | E21B 43/26 702/2 |
| 2005/0207279 | A1 | 9/2005 | Chemali et al. | |
| 2007/0018848 | A1 | 1/2007 | Bottos et al. | |
| 2007/0023185 | A1 | 2/2007 | Hall et al. | |
| 2007/0023485 | A1 * | 2/2007 | Bouet et al. | 228/119 |
| 2007/0029112 | A1 | 2/2007 | Li et al. | |
| 2008/0035375 | A1 * | 2/2008 | Burkhard | E21B 44/00 175/40 |
| 2008/0251247 | A1 * | 10/2008 | Flint | E21B 17/006 166/65.1 |
| 2009/0121895 | A1 | 5/2009 | Denny et al. | |
| 2009/0173493 | A1 | 7/2009 | Hutin et al. | |
| 2009/0289808 | A1 * | 11/2009 | Prammer | E21B 17/003 340/853.7 |
| 2010/0116550 | A1 | 5/2010 | Hutin et al. | |
| 2010/0133006 | A1 * | 6/2010 | Shakra | E21B 41/0085 175/24 |

FOREIGN PATENT DOCUMENTS

| | | | |
|---|---|---|---|
| DE | 41 29 252 | A1 | 3/1993 |
| DE | 37 89 145 | T2 | 7/1994 |
| DE | 196 25 720 | C1 | 9/1997 |
| DE | 102 14 345 | A1 | 10/2003 |
| EP | 0 408 667 | B1 | 1/1991 |
| EP | 0 431 136 | A1 | 6/1991 |
| EP | 0 468 891 | A1 | 1/1992 |
| EP | 0 565 141 | A2 | 10/1993 |
| EP | 0 683 845 | B1 | 11/1995 |
| EP | 0 699 819 | B1 | 3/1996 |
| EP | 0 900 918 | B1 | 3/1999 |
| EP | 0 987 401 | A2 | 3/2000 |
| EP | 1 116 350 | B1 | 7/2001 |
| EP | 1 213 440 | A1 | 6/2002 |
| EP | 1 225 301 | A1 | 7/2002 |
| EP | 1 227 216 | A1 | 7/2002 |
| EP | 1 332 270 | B1 | 8/2003 |
| EP | 1 434 063 | A2 | 6/2004 |
| EP | 1 556 576 | B1 | 7/2005 |
| EP | 1 915 504 | A1 | 4/2008 |
| WO | WO 91/00 413 | A1 | 1/1991 |
| WO | WO 2007/016687 | A1 | 2/2007 |

* cited by examiner

COMMUNICATION SYSTEM FOR TRANSMITTING INFORMATION VIA DRILLING RODS

CROSS REFERENCE TO PRIOR APPLICATIONS

This application is a U.S. National Phase application under 35 U.S.C. § 371 of International Application No. PCT/EP2011/001826, filed on Apr. 12, 2011 and which claims benefit to German Patent Application No. 10 2010 014 706.0, filed on Apr. 12, 2010, and to German Patent Application No. 10 2010 047 568.8, filed on Oct. 8, 2010. The International Application was published in German on Oct. 20, 2011 as WO 2011/128068 A2 under PCT Article 21(2).

FIELD

The present invention relates to a communication system for transmitting information via drilling rods of a drilling string for earth drillings, comprising a first drilling rod linkage, one or more second drilling rod linkages and a drill drive, wherein the first drilling rod linkage and the second drilling rod are formed in each case from a hollow-cylindrical drill pipe having at least one line extending in the axial direction and having an upper end and a lower end, the lower end of the first drilling rod linkage or linkages is/has a receptacle for a drill head, each of the second drilling rod linkages is connected in a rotationally fixed manner with its lower end to the upper end of the first drilling rod linkage or of another second drilling rod linkage and is connected in a rotationally fixed manner with its upper end to the lower end of a further second drilling rod linkage or to the drill drive, wherein sensors and/or actuators, from which or to which measurement, parameterizing, status and/or control data are to be transmitted, are arranged at a lower end of the first drilling rod linkage and/or at the drill head, wherein the data are transmitted or received along the drilling string to or from a communication unit at or in the drill drive, which unit is connected to a surface computer for monitoring the earth drilling which receives or provides the data of the sensors and/or actuators. Furthermore, the present invention relates to a drilling rod linkage for establishing such a communication system.

BACKGROUND

Drilling holes for gas, petroleum or geothermal exploration are typically 30 cm in diameter and approximately 2 km/1.5 miles long. These drillings are drilled with drilling strings of relatively light-weight drilling rods, screwed together, the joints being provided with hinges, of 9.14 m/30 ft or 13.72 m/45 ft length. As the drilling progresses, further drilling rods are added to the drilling string at the upper end of the drilling hole. At the lower drilling hole end of the drilling string there is usually a drill stem, the natural weight of which corresponds approximately to that of normal drilling rods placed end to end to a length of 300 m/1000 ft. The drill stem is equipped with a drill bit. Due to the weight of the arrangement and the rotating drive of the drilling string from the surface, the drill bit digs into the ground. Sometimes, drilling mud motors or drilling mud turbines are also used for the drill bit drive. Jetting mud or air is supplied to the drill bit from the surface through an axial bore in the drilling string. This fluid removes the depositions from the drilled hole via the hollow-cylindrical space between the outside wall of the rods and the wall of the drilled hole. Using a hydrostatic drill head, the gases of the ground formation are monitored or sometimes also cooling is applied to the drill bit.

Transmitting sensor data relating to parameters, such as pressure or temperature, which are detected by means of sensors at the drill string in the area of the bottom of the drilled hole, to the surface, has already been demanded for a long time. Various methods of this communication have been attempted, such as electromagnetic wave propagation via the ground formation, electrical transmission via an insulated conductor, pressure pulse propagation via the drilling mud and acoustic wave propagation via the metallic drilling string. Each of these methods has disadvantages such as, for example, relating to signal attenuation, environmental noises, high temperatures and the incompatibility with standard operating methods. The most widely used method commercially is that of information transmission by means of a pressure pulse via the drilling mud. However, damping mechanisms of the mud limit the transmission rate to approximately 2 bit/s to 4 bit/s.

A further reason for the transmission of the information via the drilling string is the result of the wish for automatic maintenance of a predetermined direction of advance. This is of importance mainly in the case of mining-related deep drilling with a drill pipe carrying the drilling bit and an outer pipe arranged rotatably on the drill pipe and provided with guide strips and press parts. Drilling rods for full and core drillings are also affected. In the case of deep drillings in above-ground and underground mining, the earth's attraction, the layering of earth formations, especially at the transition from hard to soft layers and vice versa, and also the external friction of the drilling tool and of the rods cause deviations from the predetermined direction of drilling. This applies both to core and full drillings. Especially in underground mining, where the starting and exit point of a drilling are often specified precisely, the drilling must maintain the desired direction. Such drillings are also called target drill holes. In the case of exploratory drillings for searching for unknown deposits, too, a straight-line course of the drilling is demanded. Exploratory drillings are carried out both in accordance with the core- and the full-drilling method. In the case of parallel drillings, too, such as, e.g., for dike reinforcement, the plumb line and parallelity are absolutely mandatory for reasons of later sealing of the dike installation.

For the straight-line course of the drilling, so-called target drilling rods, stabilizers or centering and guiding devices are installed. These are drilling rods with attached guide strips, the outer diameter of which corresponds to the drilling diameter and, following the advancing drilling tool, are intended to guide the latter concentrically. Target drilling rods have an inbuilt automatic vertical control which specifies and/or corrects the direction of drilling by utilizing the force of the earth's attraction and using the pressure of the jetting liquid. In the case of straight-line drillings both in accordance with the full- and the core-drilling method, intermediate measurements of direction are required even with lengths of up to 100 m, in order to align the drilling in accordance with the deviation found. This work is extremely time-consuming and expensive, especially in the case of very deep drillings or in the case of core- or full-drillings in accordance with the cable core-drilling method in which two different drilling rods and machine equipments are used. The straight-line drillings include horizontal, vertical and oblique drillings.

There is thus great interest in arranging corresponding measuring instruments as closely as possible to the drill head and/or at the drill bit of the drilling string in order to provide the correct measurement data online and in real time via the drilling string to processing facilities at the surface, in order to be able to react immediately, e.g. to deviations from the destination. Corresponding measuring instruments are, for example, inclination sensors such as inclinometers, deflectometers or pendulum plum-line meters. The transmission of measurement variables from sensors of other detection variables, i.e., other physical variables, is just as significant. In the text which follows, the prior art of facilities for transmitting information via drilling rods is acknowledged. According to the prior art, a multiplicity of types of facilities for transmitting information via drilling rods are used, depending on the field of application.

EP 1 225 301 A1 describes a "hollow drill pipe for transmitting information" consisting, on the one hand, of an electrically conductive hollow rod linkage which comprises on the inside a cylindrical layering of insulation, line and insulation, the line being exposed in each case at the ends of the rods to a length of L=0.8×D to 2.2×D for forming conductive rings and contacting the drilling mud and, on the other hand, of a drilling string of a number of rods and a drilling tool at the lower end, wherein, for the transmission of information, a first inner axial coil arrangement 1 at the lower end, which is suitable for receiving electrically alternating signals as information carriers, and a second inner axial coil arrangement 2 at the upper rod linkage for the signal reception, the signals being generated by the circulation of a current in a current loop which is formed by the conductive layer, the conductive rings, the internal mud, the wall of the rod linkage and the external mud, and wherein the current is generated by the signal which acts on the coil arrangement 1. Since the diameter D is between 2.5 cm and 11 cm, this is an extremely long and thin line both in the mechanical and in the electrical sense.

EP 1 213 440 A1 describes a "method for transmitting information along a drill string" and a device therefor, wherein each rod of the drilling rod linkage has an electrically conductive inner line for conveying the liquid which is under pressure, surrounded by an annular space filled with a fluid electrical insulator and an electorally conductive wall closed off to the outside, a first coil arrangement for inductively coupling-in being located in the vicinity of the closing lower end of the drilling rod linkage, arranged in the annular space, enclosing the inner line, and a second coil for inductive coupling-out being located in the vicinity of the upper end of the rod linkage in the same arrangement. A battery-fed measurement sensor is additionally located in the vicinity of the drill head, the signal of which sensor is supplied amplitude-processed and frequency-processed to the first coil, transmitted and received and processed by the second coil. The coils can also be switchably used as transmitting and receiving coils. A further transmitting coil is also provided in the vicinity of coil 2 and a further receiving coil in the neighborhood of coil 1. The arrangement represents electrically a coaxial line consisting of an inner conductor, cylindrical insulating layer and an outer conductor. The quality of the transmission is dependent on material, medium, rotational speed, length, amplitude and frequency.

EP 468 891 A1 describes a "dynamometric measuring assembly for drill pipe with radio transmission means" which has measurement sensors permanently connected to a rotatable shaft and a first electronic circuit for processing the signals provided by the measurement sensors, the signals being conducted to a stationary detection unit which is remote from a radio transmitter permanently mounted on the rotatable shaft and the device also having a radio receiver for receiving the signals transmitted by the detection unit, and the radio receiver has facilities for parameterizing or controlling the measuring device in response to the signals transmitted by the detection unit. The measurement sensors of the force measuring device are installed above ground as is the radio link so that the rotating radio source and the stationary sink remains as special technical feature.

WO 91 00 413 A1 describes a "device for force measurement for a drilling rod linkage" where the radio link described in EP 468 891 A1, having a similar structure of measurement sensors for the force measurement of the drill shaft, is replaced by a collector, corotating with the drilling rods, with fixed brush pick-off. Preceding and following electronic circuits are used for measurement value editing and processing. Since the force measurement does not take place at the location of the event, i.e., at the drilling head or in its immediate vicinity, the result of the measurement must be adapted to the actual conditions and post-processed, in any case.

EP 1 915 504 A1 describes a "Bidirectional drill string telemetry system for measurement and drilling control", consisting of a drilling platform with drilling tower and a suspension with hook and rotary hinge for the drill string, a drilling table with follower rod, a pump for the drilling fluid which is conveyed from a pit via the rotary hinge into the interior of the hollow-cylindrical drilling rods and, emerging over the drill bit, is pressed upward as drilling mud between outer drilling string wall and drill hole, with electronics equipment below the rotary hinge which communicates wirelessly, on the one hand, with the building site control computer and, on the other hand, with the surface participant of the drilling string which forms an information-related termination of a network of drilling rods, the drilling rod linkages being wired over their length (wired drill pipe (WDP)) and having at their respective end in each case an inductive coupling to next drilling rod linkage and, dependent on the length of the drilling string, intermediate amplifiers, and an arrangement of control and measuring devices above the drill bit (bottom hole assembly (BHA)), and a motor controller, various logging (logging while drilling (LWD)) and measuring (measurement while drilling (MWD)) modules which terminate with an interface participant towards the wired drilling rods. The wired, inductively coupled rods which extend from the surface participant to the interface participant form the drilling string telemetry system.

U.S. Pat. No. 7,040,415 two further telemetry systems with their methods, wherein the drilling string data are picked up once via slip rings at the drilling platform and conveyed to the building site computer and, in another example, by means of a wireless transmission. The rod linkages are in each case equipped with two pairs of lines, the adapters connected between the rod linkages providing inductive coupling between the two pairs of lines.

EP 1 556 576 B1 describes a "Drill pipe having an internally coated electrical pathway" where hollow-cylindrical drilling rods connectable to one another by screwing are coated with insulation on the internal circumferential area and are then provided with electrically conductive coating on the cylindrical insulating area. The method is continued with a further insulating layer on the conductive layer and a further conductive layer on the insulating layer deposited last so that two electrical hollow-cylindrical conductors are located underneath a hollow-cylindrical insulator up to the inner pipe wall of the rod linkage. A further measure is taken at the point of transition of two drill pipes in such a manner that connectors, insulated electrically towards the outside, fluid-sealed and provided with electrical conductors in the interior, electrically connect the insulated electrical path of each such rod linkage to the insulated electrical path of the corresponding neighboring rod linkage. This also occurs via the electrically conductive hollow-cylindrical layers over several layers so that at least one insulated electrical path is produced continuously from an upper end of the drilling string to a lower end of the drilling string. The considerable vibrations and forces occurring at the screwed transition points of the rod linkage require an uninterrupted electrical at the connectors which can scarcely be achieved.

EP 1 434 063 A2 describes a "drill string telemetry system and method" with a telemetry system and a telemetry method for communicating information via a drilling rod linkage. The information of a sensor in the drill bit is modulated onto a carrier signal with the aid of a transmitter and a transmitter coil and transmitted at medium to high frequency from a first position via the drilling rod linkage to a second position, received and demodulated by means of a receiver and a receiver coil and processed further in the processor. By means of the arrangement, it is intended to directly detect technical drilling information which influences the quality of the drilling and extends the life of the drill bit device through knowledge of the current temperature of the motor bearing shells and the current rotational speeds of the motor drive shaft.

SUMMARY

An aspect of the present invention is to provide a novel facility for transmitting information via drilling rods which overcomes the disadvantages of the prior art and provides for reliable transmission of the information within the drilling string.

In an embodiment, the present invention provides a communication system for transmitting information via drilling rod linkages of a drilling string for earth drillings which includes a drill drive, drilling rod linkages comprising a first drilling rod linkage and at least one second drilling rod linkage. The first drilling rod linkage is formed from a hollow, cylindrical drill pipe comprising at least one electrical line extending in an axial direction, an upper end and a lower end. The lower end of the first drilling rod linkage comprises a receptacle for a drill head. The at least one second drilling rod linkage is formed from a hollow, cylindrical drill pipe comprising at least one electrical line extending in an axial direction, an upper end and a lower end. Each of the at least one second drilling rod linkage is connected in a rotationally fixed manner via the lower end to the upper end of the first drilling rod linkage or to the upper end of another second drilling rod linkage, and is connected in a rotationally fixed manner via the upper end to the lower end of a further second drilling rod linkage or to the drill drive. At least one of a sensor and an actuator is arranged at least at the lower end of the first drilling rod linkage and at the drill head. The at least one of a sensor and an actuator is configured to transmit data which includes at least one of measurement data, parameterizing data, status data and control data. A first communication unit and an electronics unit are arranged at a drive end, at or in the drill drive. The first communication unit and the electronics unit are connected to each other. A surface computer is configured to monitor an earth drilling. The surface computer is communicatively connected to the electronics unit at the drive end and is configured to receive or to provide the data of the at least one of a sensor and an actuator. At least one further communication unit is arranged at the upper end of the first drilling rod linkage, and at least one further communication unit is arranged at the upper end and at the lower end of the at least one second drilling rod linkage, respectively. At least one electronics unit comprising a microcontroller is arranged in each drilling rod linkage. At least one power supply for the further communication units and for the at least one electronics unit is arranged in each drilling rod linkage. The at least one of a sensor and an actuator and the at least one further communication unit arranged at the upper end of the first drilling rod linkage are connected to one another via the at least one electrical line. The at least one electronics unit of the first drilling rod linkage is arranged between the at least one of a sensor and an actuator and one of the further communication units of the first drilling rod linkage with respect to the data. The further communication units of each second drilling rod linkage are connected to one another via their respective at least one electrical line, the electronics unit of the respective second drilling rod linkage being located between the further communication units with respect to the data. The first communication unit and the further communication units are each radio modules, and are each configured to at least one of transmit data to and to receive the data from at least one of an immediately adjacent further communication unit of a next drilling rod linkage or from the drill drive.

BRIEF DESCRIPTION OF THE DRAWINGS

The present invention is described in greater detail below on the basis of embodiments and of the drawings in which.

DETAILED DESCRIPTION

Figure 1:
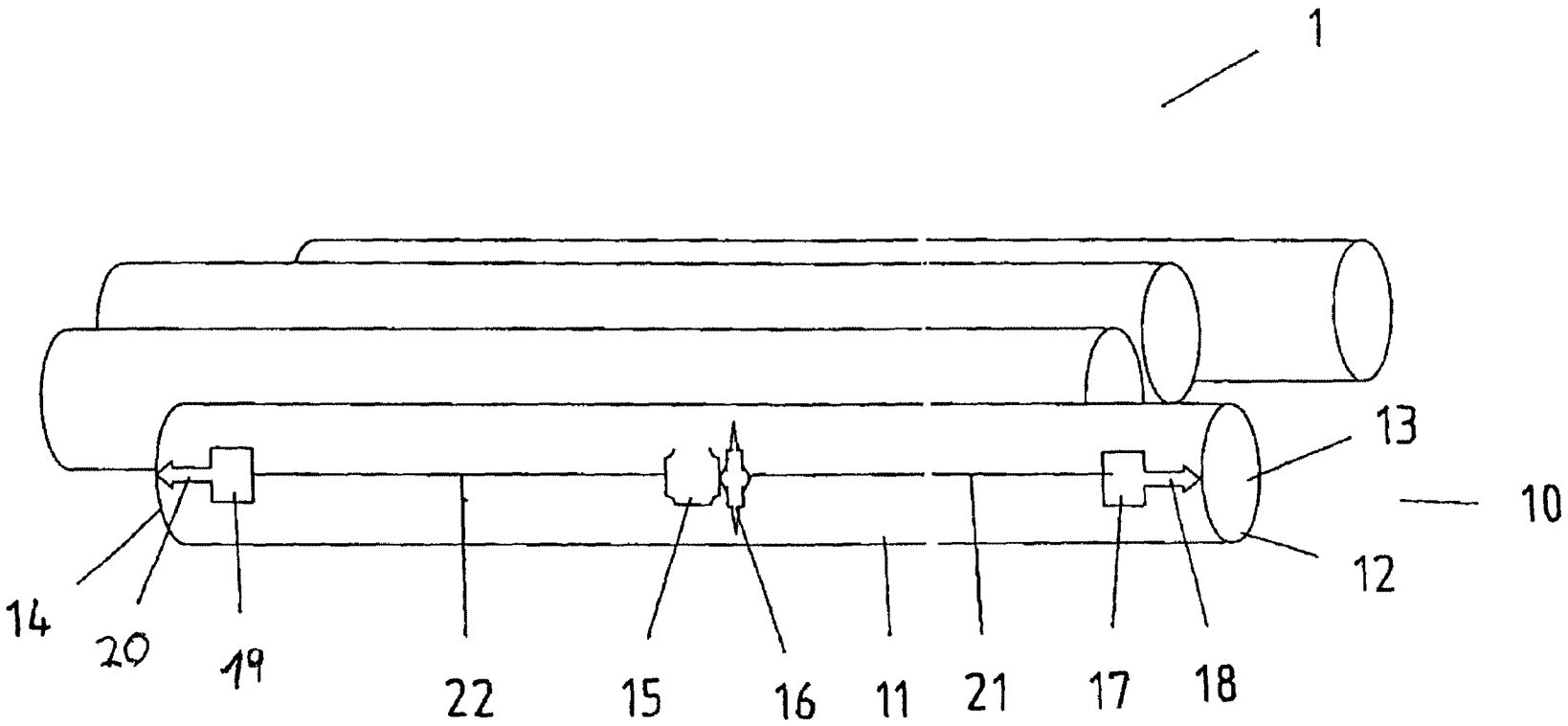
FIG. 1 shows stacks of prepared drilling string linkages, or REST mode.

According to the present invention, a communication system for transmitting information via drilling rod linkages of a drilling string for earth drillings is proposed, comprising a first drilling rod linkage, one or more second drilling rod linkages and a drill drive, wherein the first drilling rod linkage and the second drilling rod linkage or linkages is/are formed in each case from a hollow-cylindrical drill pipe having at least one line extending in the axial direction and having an upper end and a lower end, the lower end of the first drilling rod linkage has a receptacle for a drill head, each of the second drilling rod linkages is connected in a rotationally fixed manner with its lower end to the upper end of the first drilling rod linkage or of another second drilling rod linkage and is connected in a rotationally fixed manner with its upper end to the lower end of a further second drilling rod linkage or to the drill drive, wherein the communication system furthermore comprises:

sensors and/or actuators from which or to which measurement, parameterizing, status and/or control data are to be transmitted and which are arranged at the lower end of the first drilling rod linkage and/or at the drill head, a first communication unit and an electronics unit at the drive end, both of which are arranged at or in the drill drive and are connected to one another, a surface computer for monitoring the earth drilling, which is communicatively connected to the electronics unit at the drive end and receives or provides the data of the sensors and/or actuators, further communication units, at least one of which is arranged at the upper end of the first drilling rod linkage and at least in each case one is arranged at the two ends of the second drilling rod linkage or linkages, at least one electronics unit (15) with a microcontroller in each case in the drilling rod linkages, and at least one power supply for the communication units and the electronics unit in each case in the drilling rod linkages, wherein the sensors and/or actuators and the communication unit of the first drilling rod linkage are connected to one another via its electrical line and the electronics unit of the first drilling rod linkage is located between the sensors and/or actuators and the communication unit of the first dilling rod linkage with respect to data, and the communication units of each second drilling rod linkage are connected to one another via its electrical line, wherein the electronics unit of the respective second drilling rod linkage is located between the communication units with respect to data, and wherein the communication units are radio modules and each of the communication units is arranged for transmitting the data to the immediately adjacent communication unit of the next drilling rod linkage or of the drill drive and/or for receiving data from this unit.

The basic concept of the present invention consists in providing a data transmission along a drilling string for earth drillings in such a manner that a cable-connected transmission of the data takes place within the individual drilling rod linkages of the drilling string and the transmission at the junctions of the drilling rod linkages is wireless. For the cable-connected transmission, wiring within the drilling rod linkages is used (WDP), whereas at the respective ends of the drilling rod linkages, radio transmission modules directed towards one another are arranged which only bridge the connecting gap between one another. By this means, a reliable, interference-free and effective data transmission is achieved along the drilling string by means of which drilling hole data are acquired in real time and during the drilling operation (online) and can be transmitted to the surface computer without the ground formation or other environmental conditions at the drilling hole having any influence on the quality of the data transmission.

The communication system according to the present invention is versatile and offers an online and real-time measurement value transmission link for drilling string data, drill head data and/or drill bit data, the sensors for detecting the measurement data being located as closely as possible in the immediate vicinity of the drill head and/or of the drill bit, for example, even on the drill head and/or the drill bit. In the text which follows, the term drill bit is understood to be that part of the end of a drilling string on the side of the bore hole bottom which has the cutting elements digging into the ground, whereas drill head designates the total arrangement at the lower end of the first drilling rod linkage comprising drill head, auger or drilling cutter and corresponding connecting means to the drilling rod linkage.

In other cases of application, e.g., in the case of great lengths of the drilling string, sensors and/or actuators can be mounted or installed also in or at at least one further drilling rod linkage in addition to the arrangement at the drill head in order to obtain information, i.e., sensor measurement and/or status data from various positions along the drilling string or transmit parameter and/or control data to sensors or actuators which are located at various locations on the drilling string. Important sensors to be mentioned here are pressure or temperature sensors. Actuators can be valves, motors or pumps.

The communication system is simple and maintenance-free and the installation and commissioning can be done on site by technically trained personnel. It is versatile, especially also in regions of drilling technology for special subsurface mining such as water drilling, pile boring and the "in-situ soil mixing" technology with the three applications of "Deep Soil Mixing (DSM)", "Shallow Shallow Mixing (SSM)" and "Backhoe Stabilization" (BOSS).

The in-situ soil mixing methods are characterized by the fact that the target are soil compactions and soil stabilizations in which the ground is loosened by drilling or milling, during the drilling down of the drill or milling cutter an application-specific suspension is already introduced, during the retraction cement is added in addition to the suspension and mixed with the ground/soil and possibly subsequently also reinforced with iron posts. The support construction and soil excavation normally used is omitted. In this way, depths of up to 55 m are handled, the correct parallelity and plumb line of the drillings being of greatest significance in order to obtain a homogeneous soil stabilization.

The same applies in dike sealing and dike stabilization since in the case of non-parallelity and lacking plumb line, during the insertion foundationless gaps are produced which can be flushed free or flushed out by the water as a result of which the dike is hollowed out or undercut. In contrast to the geophysical drillings presented above or the water and pile borings, no bore holes are produced as part of the "in-situ soil mixing" technology, especially not for measuring the plumb line. Nevertheless, measuring the plumb line is absolutely mandatory online and in real time during the current advance.

For mixing the soil, a dual drill drive or dual milling tool drive is used with two counter-rotating tools which provide for maximum thorough mixing of the soil/ground. An internal high-pressure rod linkage with continuous cross section from rotating swivel to mixing tool provides for an application-oriented low-maintenance use at operating pressures of up to 10 MPa/100 bar. A mechanically adjustable guide slide enables the axial distance of the drive motors to be changed from 500 mm to 1100 mm, as a result of which the production of resolved, tangential or crossed mixing poles becomes possible. Speed and torque are controlled via an electrically switchable two-speed valve installed in the motor hydraulics.

According to the present invention, it is proposed to wire the individual drilling rod linkages with one or more pairs in the axial direction (WDP) so that at least one electrical line is located between the two ends of a drill pipe which can be used for data transmission from one end to the other. The electrical line can lie in a comparatively thin tube which extends at least from section to section at the hollow drill pipe in the manner of a cable duct, for example, on the inside, axially parallel to the latter. By using an electrical line for the data transmission from one end of the drilling rod linkage to the other end of the drilling rod linkage, the quality of the data transmission is independent of the length of the drilling rod linkage.

In an embodiment of the present invention, the power supply can, for example, be formed by batteries so that it is autonomous and no external feeding of a current for the communication units is necessary. It is furthermore of advantage to make the power supply switchable so that in the cases in which no data transmission via a drilling rod linkage is necessary, for example, during their storage in a store yard or with a relatively long pause in the drilling, the current supply for the electronics and the communication units is switched off. This saves battery capacity and extends the period of power supply utilization.

The power supply and/or the electronics can, for example, be arranged approximately in the axial pipe center of a drill pipe. This has the effect that the same cable length exists in both directions so that attenuation effects or other parasitic effects are balanced in both transmission directions during the data transmission and voltage supply.

At the ends of the drilling rod linkages, at least one radio-controlled communication unit fed by the power supply is provided in each case which are constructed either as transmitter or as receiver or as a combined transceiver. Such transmitters, receivers and combined transceivers and are commercially available and are not shown in greater detail in the text which follows. If only unidirectional data transmission is required, it is sufficient to use transmitters and receivers as data modules wherein a transmitter is arranged at one end of a drilling rod linkage and a corresponding receiver is arranged at the other end and the drilling rod linkages are mounted together in such a manner that at the junction, a transmitter of one drilling rod linkage is opposite a receiver of the other drilling rod linkage. Bidirectional communication is achieved if a transmitter and a receiver are arranged at each end of a drilling rod linkage. This can take place in separate communication units or alternatively in the said combined transceiver.

In consequence, the communication units are arranged, according to the present invention, in such a manner that in the unidirectional transmitting direction from bore hole bottom to surface, e.g., in the case of the transmission of measurement data, a transmitter is located at the upper end of the n-th drilling rod linkage and a receiver is located at the lower end of the adjoining (n+1)th drilling rod linkage. For the reverse unidirectional operation from the surface to the bore hole bottom, it can be provided that a transmitter is arranged at the lower end of the (n+1)th drilling rod linkage and a receiver is arranged at the upper end of the adjoining n-th drilling rod linkage. The radio equipment of the drilling rod linkage in the case of bidirectional radio traffic can then be carried out simplified by means of combined transceivers. This has the advantage that no type distinction of the drilling rod linkages and no directional orientation of these is necessary.

The electronics inside a drilling rod linkage control the data transmission from one communication unit to the other communication unit or to or from the sensors/actuators, respectively. It can be used as amplifier and signal conditioner for the data to be transmitted. For this purpose, the electronics contain a microcontroller.

In an embodiment of the present invention, each drilling rod linkage has an inclination sensor for detecting the attitude of the respective drilling rod linkage. It is thus possible to determine by means of the inclination sensor whether the corresponding drilling rod linkages are in a horizontal attitude, for example, stored at the store yard, or in a vertical attitude, e.g., when they are being used. The inclination sensor used can be, for example, a simple mercury switch, a gyroscopic sensor, or one or more acceleration sensors. The inclination sensor can also be arranged approximately in the axial center of a drilling rod linkage.

The inclination sensor can be used as switch for the power supply. For this purpose, it can, for example, be connected to the power supply and is arranged for switching on the power supply for the electronics unit and for the communication unit or units upon a transition of the drilling rod linkage from a horizontal attitude to a vertical attitude and for switching it off upon a transition of the drilling rod linkage from a vertical attitude to a horizontal attitude. This means that in the case of an approximately horizontal attitude of the drilling rod linkage such as, e.g., in a store yard or during transportation, the power supply is switched off and in the case of an approximately perpendicular operation or when leaving the horizontal attitude, the idle state of the power supply for the microcontroller and the radio modules is switched on.

For horizontal drillings or inclined drillings, suitable compensation measures such as, e.g., magnetic switches, can be provided in every drilling rod linkage in order to switch on the power supply and activate the electronics unit in spite of an essentially horizontal attitude of the corresponding drilling rod linkage or in order to change the logic of the inclination switches.

In an embodiment of the present invention, the power supply can, for example, be rechargeable. For this purpose, the batteries can be formed by chargeable accumulators. In the case of a permanently installed power supply, the charging can basically take place in the state mounted in the drilling rod linkage, the drilling rod linkage including its mounted power supply being connected to a charging station via charging cables. Taking into consideration the dimensions and the weight of a drilling rod linkage and the use at a construction site, it is of advantage, however, to provide the power supply as removable at or in the drill pipe, especially to make it pluggable. In this manner, it can be removed in simple and rapid manner from the drill pipe in order to charge it or recharge it. Discharging for the purpose of regeneration is also possible. After the charging process, the power supply can then be reconnected to the corresponding receptacle at the drill pipe. For this purpose, the receptacle has electrical plug-in contacts via which the power supply can be or is connected to the electronics and/or to the communication units.

The charging process can take place at a locally stationary charging location or by means of a mobile charging device which operates on the basis of a method for wireless power transmission, known in the prior art, such as, e.g., 'wireless power transmission by means of closely coupled magnetic resonances' or 'return channel message transmission by means of receiving antenna impedance modulation'.

In an embodiment of the present invention, the drill pipe can have means for automatically recharging the power supply during the operation of the drilling rod linkage additionally or as an alternative to charging the power supply at a charging station. As a result, removal of the power supply for the purpose of recharging can be largely avoided. Such a means can be, for example, a turbine which drives an electrical generator and is driven by the medium introduced under pressure into the interior of the drilling rod linkage, e.g., jetting water, a suspension or cement, or by the drilling mud which streams to the earth's surface on the outside between drilling rods and bore hole wall. An alternative means is a Seebeck element which generates a voltage from a temperature difference between the medium introduced into the drilling rod linkage and the drilling mud, which can be used for charging the power supply.

In an embodiment of the present invention, the power supply can, for example, have at least one visual and/or audible means for indicating the charging state, the residual capacity and/or supply period still available. Such a charging state indicator is used for charging control. In this context, both the actual charging state can be indicated as well as a prediction about the state of capacity of the rechargeable storing power supply.

The drill pipe of each drilling rod linkage can have at least one recess for the protected accommodation of the power supply, the electronics unit and/or one of the communication units. In this recess, the power supply, electronics unit and/or communication units accommodated are insulated from the media surrounding the drilling rod linkage. The recess can be provided on the outside at the drill pipe, being formed by a steel pocket in this case. As an alternative, the recess can extend into the interior of the drill pipe so that no protruding parts are present on its outer surface. The precise arrangement of the recess over the length of the drill rod linkages can be adapted to the accessibilities.

Plug-in contacts for electrical plug-in contacting of the power supply, the electronics unit and/or one of the communication units are then located in the recess. Sensors and/or actuators can additionally have been or can be connected to the power supply and/or the electronics unit via the plug-in contacts.

If a communication unit is used in a recess of the drill pipe, it is protected by the drill pipe or by the wall bounding the recess, respectively. As an alternative, a communication unit of a drilling rod linkage can also have a robust, especially metallic housing by means of which it is mounted on the outside of the drill pipe. As a result, the communication unit is more easily accessible.

In an embodiment of the present invention, the housing of a communication unit has an opening, closed by a non-metallic material, for example, plastic or ceramic, which is oriented in the direction of the outer edge of the end at which the corresponding communication unit is arranged. This has the advantage that the communication unit, on the one hand, is protected from the materials in the bore hole and, on the other hand, a largely unimpeded reception and/or largely unimpeded radiation of radio signals is possible through the opening. In this context, an antenna of the radio module is located immediately at or even in the opening for the radiation and/or reception of radio signals. In contrast, a completely metallic housing would prevent the reception and emission of radio signals.

If a communication unit is lying in a recess of the drill pipe of a drilling rod linkage, this, too, can have an opening closed by a non-metallic material, for example, plastic or ceramic, which is oriented in the direction of the outer edge of the end at which the corresponding communication unit is arranged.

In an embodiment of the present invention, the power supply and the electronics unit can, for example, form one constructional unit. As a result, the electronics unit can be designed to be compact and it does not need to be cabled separately to the power supply. This facilitates the handling of the drilling rod linkages and reduces the effort for preparing the drilling rod linkages.

A drilling rod linkage can furthermore have an electronics unit for each communication unit, wherein, communication unit and electronics unit can in each case form one constructional unit. In the same manner, a drilling rod linkage can have a power supply for each communication unit, wherein communication unit and power supply form one constructional unit.

This, too, simplifies the handling, reduces the number of components and, as a result, facilitates the equipping of the drilling rod linkages. In an embodiment of the present invention, a communication unit, an electronics unit and a power supply can jointly form one constructional unit so that, apart from the drilling rod linkage accommodating the drill head, only two components have to be arranged at each drilling rod linkage and connected via the electrical line.

The first drilling rod linkage forms a first end of the drilling string and has the sensors for measurement values and parameters to be measured and to be transmitted to the surface in the vicinity of the drill head. It is formed from a hollow-cylindrical drill pipe which has an upper end and a lower end, having at least one electrical line located between the upper and the lower end which is conducted to the two ends, wherein the lower end has a receptacle for a drill head and the upper end can be connected in a rotationally fixed manner to the lower end of another drilling rod linkage or to a drill drive, wherein sensors and/or actuators, from which or to which data can be transmitted, are arranged at the lower end and a communication unit is arranged at the upper end, at least one electronics unit having a microcontroller and at least one power supply for the communication units and the electronics unit are present, wherein the communication unit and the sensors and/or actuators are connected to one another via the electrical line and the electronics unit is located between the sensors and/or actuators and the communication unit with respect to data, and the communication unit is a radio module, wherein the communication unit is arranged for transmitting data to an immediately adjacent communication device of the next drilling string or of the drill drive and/or for receiving data from this device. In consequence, the sensors are connected to the electronics unit of the first drilling rod linkage via the one- or multi-pair electrical line and transmit the measurement values in analog or digital manner as electrical signals via this line.

At the upper end, opposite to the lower end, of the first drilling rod linkage, a communication unit designed as radio module is located which forms a transmitter or a combined transceiver. The first drilling rod linkage, too, can have in its axial center a rechargeable storing power supply and an inclination sensor as energy switch for the electronics unit and the radio module. The first drilling rod linkage differs from the second drilling rod linkage or linkages in the sensors and/or actuators which are arranged close to the drill head instead of a communication unit.

The second or each second drilling rod linkage forms an intermediate drilling rod linkage which is mounted between the first drilling rod linkage comprising the drill head, and the drill drive. For this purpose, it is positioned on the surface at the end opposite the first end of the drilling rod linkage and mounted at the first drilling rod linkage and the drive. It forms a drilling rod linkage for a drill pipe for earth drillings for establishing the communication system according to the present invention, having a hollow-cylindrical drill pipe which has an upper end and a lower end and having at least one electrical line located between the upper and the lower end, which is conducted to the two ends, wherein the lower end can be connected in a rotationally fixed manner to the upper end of another drilling rod linkage and the upper end can be connected in a rotationally fixed manner to the lower end of another drilling rod linkage or to a drill drive, wherein at both ends, at least one communication unit is arranged, at least one electronics unit with a microcontroller and at least one power supply for the communication units and the electronics unit are present, wherein the communication units are connected to one another via the electrical line and the electronics unit is located between the communication units with respect to data, and the communication units are radio modules, wherein each of the communication units is arranged for transmitting data to an immediately adjacent communication device of the next drilling string or of the drill drive and/or for receiving data from this device.

In an embodiment of the present invention, the or a second drilling rod linkage has at its lower end, referred to its vertical arrangement, a receiver or a combined transceiver, a one- or multi-pair electrical line via the drilling rod linkage and, for example, in the axial center, a rechargeable storing power supply, and an inclination sensor as switch for the electronics unit and the radio module. At the upper end, referred to its vertical arrangement, the second drilling rod linkage has at least one radio transmitter or a combined transceiver for the bidirectional data transmission, wherein the transmitter or transceiver is connected with respect to data via a radio link to the communication unit of the drill drive, the electronics unit connected to it and the surface computer of the drilling site, connected to the electronics unit, and transmits the sensor data uni-directionally with priority from the drill head environment.

If it is also intended to activate actuators along the drilling string within the bore hole, the communication system according to the present invention must be designed to be bidirectional so that control data can be transmitted to the actuators. By this means, sensors can also be dynamically parameterized, wherein parameter data can be transmitted to the sensors.

According to the previous explanation, the drilling string or the communication system consisting of wired drilling rod linkages and radio links at the joints of the linkages comprises only two different basic types of drilling rods, namely the first drilling rod linkage which forms a drill head linkage and the second drilling rod linkage or linkages which form intermediate drilling rod linkages. The first drilling rod linkage is characterized by its receptacle of the drill head, sensors and/or actuators in the vicinity of the drill head and a radio module at only one end, whereas the second or each second drilling rod linkage has in each case at least one radio module at both ends.

In an embodiment of the communication system of the present invention, sensors and/or actuators are also used in other rod linkages of the drilling string. These rod linkages supply additional information to these sensors or additionally receive information for their actuators. By means of the additional information, more or more robust information of the total drilling string can be determined.

As previously described, a basic concept of the communication system according to the present invention consists therein, that the radio link between the drilling rod linkages always occurs only via the comparatively short distance, i.e., over the length of a connection of a rod linkage from an n-th rod linkage to an (n+1)th rod linkage. The radio link therefore does not exist over the entire length of one or even more rod linkages. This means that the bore hole environment, particularly the nature of the ground formation or the use of drilling mud or suspension or cement for soil stabilization which can/could influence the quality of the information transmission decisively in the drilling method presented above, does not significantly influence the communication system according to the present invention with wireless data transmission.

The radio modules can be adjusted to constant field sizes and field parameters. With regard to this adjustment, there are no distinguishing features with respect to the types of drilling rod linkages.

Due to the mechanical situations at the ends of the drilling rod linkages, especially with regard to the connecting means present there such as screw caps, the communication units must be mounted, for example, in each case at a distance of 15 cm to 20 cm before the outer edge of an end of the drilling rod linkage, which results in there being a radio link of only 30 cm to 40 cm. The communication units can therefore be arranged for near-field communication in such a manner that their transmitter ranges are less than 1 m, for example, only between 30 and 50 cm. This embodiment leads to calculable transmission powers between the radio modules which also allows the power balance of the rechargeable storing power supplies to be calculable.

The use of a drilling string formed of such drilling rod linkages can be planned independently of the environmental conditions. In the operation of such a drilling rod linkage, no special knowledge is required from the drilling site personnel about the application of the information transmission/radio communication technology and no special restrictions need to be observed.

In an embodiment of the present invention, it is proposed to allocate an unambiguous identifier to each drilling rod linkage, via which it is identifiable. On the one hand, this enables the logistics to be simplified in the administration of the drilling rod linkages. On the other hand, the identifier offers the possibility of unambiguously identifying and addressing each drilling string networked with respect to data or to be networked in a network. According to the present invention, therefore, each drilling rod linkage can form a node in an ad-hoc network which is built up from the individual drilling rod linkages at the bore hole. With respect to data, the electronics unit together with the communication unit or units connected to it form a network node in this case.

An ad-hoc network is a simple wireless local area network (WLAN) networking variant which provides for direct peer-to-peer communication without access point (base station) as information broker and is well suited for small and/or time-limited networks. The communication units of the communication system can, therefore, be arranged for transmitting the data by WLAN. In the ad-hoc operating state, the radio network nodes communicate directly with one another without central WLAN access point in order to exchange data or folders in a simple manner. Ad-hoc networks operate on the basis of the beaconing mechanism in which each network node sends a beacon (radio signal) at regular intervals. Each node thus knows its neighbor which it can reach directly. All nodes use the same frequency when transmitting. The entire network structure arises dynamically by self-organization and self-administration, the network management is distributed over the nodes. There is no central administration which establishes the network structure and the routing, i.e., the route allocation. The tables for the routing are stored in each network node. Each node has a router component.

Due to the mobility of the nodes, the network structure varies with time. Entry into an ad-hoc network is effected by interaction with other participants. The radio nodes operate in the ad-hoc state and are ad-hoc configured in accordance with the international IEEE 802.11 standard. So that all nodes can communicate with one another, the channel number and the service set identifier (SSID) to be set for each node must be identical. Data, information or signals are forwarded from network node to network node until they have reached their receiver, as a result of which the data load is distributed more advantageously than in networks having a central access point. Using methods for the routing, the ad-hoc network continuously adapts itself when network nodes are moving, added or fail. In the case of the failure of a network node, the network attempts to reach the destination node by bypassing the failed node.

The identifier can be stored, for example, in the electronics unit and/or in one or more of the communication units and queried by the communication unit at the drive end as soon as a drilling rod linkage is mounted on the drill drive and the communication unit of the drill drive picks up radio connection with the communication unit arranged at the upper end of the drill rods. This assumes that at least the radio link, for example, also the electronics unit of the drilling rod linkage are already fed at least with an idle current by the power supply, i.e., the power supply is connected. This can be done automatically via the aforementioned inclination sensor.

The identifier interrogation can be triggered automatically, for example, via a mechanical switch at the drill drive which is operated during the assembly of the drilling rod linkage. As an alternative, the drill drive can have a proximity sensor which is triggered and initiates the identifier interrogation as soon as a drilling rod linkage passes into its detection range. In an embodiment of the present invention, each drilling rod linkage has an RFID transponder, for example, a passive RFID transponder in which the aforementioned or another unambiguous identifier is stored. The drill drive can then have a proximity sensor with an RFID reader which is connected to the electronics unit at the drive end and is arranged, on approaching a drilling rod linkage, for activating its RFID transponder for sending out the identifier.

The identifier obtained from the RFID reader or from the radio module at the drive end can then be supplied to the electronics unit of the drill head and from this to the surface computer which imports the identifier (ID) of the 'new' rod linkage into the ad-hoc network.

If a further drilling rod linkage of the type described above is added to an existing drilling string from a store yard, the inclination sensor will switch on the power supply due to the change in attitude of the drilling rod linkage from horizontal to vertical attitude and activate the electronics unit and the communication units which were previously in a sleep mode.

As an alternative, the RFID transponder can be an active RFID transponder which is connected to the power supply and arranged for switching on the power supply and/or activating the electronics unit and communication units when it receives an activation signal from the RFID reader. The corresponding drilling rod linkage then passes from the sleep mode into an activated mode.

With reference to the respective drilling rod linkage, it is proposed according to the present invention to distinguish between three operating states:

- a first operating state (REST mode) in which the drilling rod linkages are stored in horizontal attitude on a store yard as stacked goods,
- a second operating state (READY mode) into which the rods change when they are taken from the stack, transported and erected vertically, and
- a third operating state (SET mode) into which the drilling rod linkages change when they are mounted between the existing drill string and the kelly of the drill drive.

In the REST mode, maintained and prepared drilling rod linkages equipped with in each case at least one power supply are stored as stacked goods horizontally retrievable on a store yard close to the building site. The wired drilling rod linkages (WDP) are equipped with radio modules, the electronics unit is also accommodated in the linkage but is in the switched-off state, i.e., in the so-called zero current mode.

For the transition into the READY mode, a prepared rod linkage is taken from the stack, transported to the near drilling location and erected. The inclination switch which is also supplied with idle current in the REST mode switches on the power supply for the electronics unit when the rod assembly is moved from the horizontal to the vertical attitude. Both the horizontal and vertical attitude can be defined in a tolerance field in the electronics unit in such a manner that oblique drilling is also possible within the scope of the switching action of the inclination sensor. The switching causes the electronics to be enabled in the sense of a logic being activated and a minimum idling current flowing into the electronics unit. The rod assembly electronics are electrically in a sleep mode in which they are in a standby position.

In the SET mode, the prepared 'new' rod assembly, which is in the sleep mode, is transported to the topmost rod assembly of the drilling string, from which the drill drive has been removed in the meantime, and placed on with its lower end and rigidly screwed to it mechanically. After that, the kelly of the drill drive of the drilling arrangement is placed on the upper end of the 'new' rod assembly and also screwed to it mechanically rigidly. In this context, the proximity sensor arranged in the head of the kelly is activated, which causes its RFID reader to interrogate the identifier (ID) of its opposite RFID transponder at the upper end of the 'new' rod assembly. By means of this procedure and knowing the identifier and master data identifying the new rod assembly, these are conveyed to the surface computer by the electronics unit at the drive end.

This can be done via a radio link. The surface computer in turn performs a synchronization of all data in such a manner that the new linkage forms a new node within the drilling string ad-hoc network. By means of this represented procedure, drilling rod linkages are fully automatically and self-organized registered in the ad-hoc network to be built up and integrated there so that each drilling rod linkage forms an individually addressable network node within the network.

Hereinafter, identical and identically-acting components of the exemplary embodiments are in each case provided with the same reference symbols in the Figures.

FIG. 1 shows a stack 1 of prepared drilling rod linkages 10 in REST mode for a drilling string. The individual drilling rod linkages 10 consist of a drill pipe 11 having the wall thickness 12, an upper end 13 and a lower end 14 wired with one or more pairs in the axial direction (WDP) so that two electrical lines 21, 22 are formed.

Drilling rod linkages 10 have in the axial center of the pipe an electronics unit 15 with a microcontroller and a switchable electrical power supply which supplies at least one pair of the two electrical lines 21, 22 with power, the electronics unit 15 and the power supply constructionally forming one unit.

At its upper and lower ends 13, 14, a drilling rod linkage is in each case equipped with a radio-controlled commercially available transmitter and/or receiver or transceiver (radio module/communication unit) 17, 19 which has in each case an antenna 18, 20 and which are also fed via the aforementioned power supply.

The power supply is rechargeable and permanently installed or designed to be portable. Removal of the pluggable power supply is used for charging and/or recharging it and is added again to the supply consumption of the linkage after the charging process. The power supply is accommodated protected in steel pockets of the linkage, wherein electrical connections to sensors, actuators, transmitters and/or receivers are present in the pockets. Approximately in the center of the pipe, there is an inclination sensor 16 which switches the power supply in dependence on attitude. The inclination sensor 16 itself is supplied with standby current in the horizontal attitude.

The drilling rod linkages 10 prepared for the drilling or milling process are lying retrievably in REST mode on the stack 1. From the point of view of information processing, each drilling rod linkage 10 with a microcontroller-controlled electronics unit 15 and radio modules 17, 19 forms one node of a network.

Figure 2:
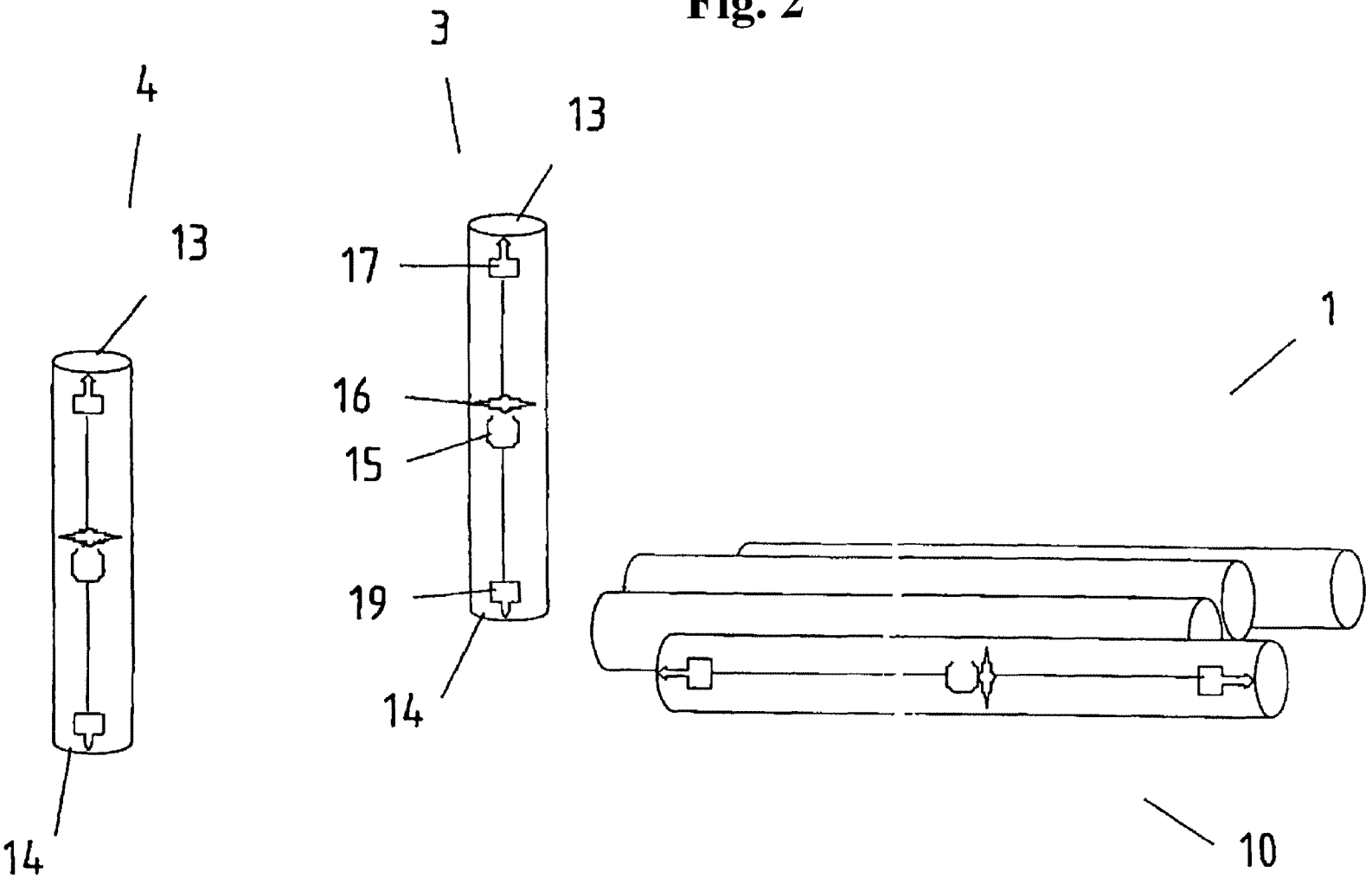
FIG. 2 shows removing linkages from the stack, erecting, transporting, or READY mode.

FIG. 2 shows on the right the drilling rod linkage storage location 1 at which the drilling rod linkages 10 are stacked horizontally. On retrieval, a linkage 3 is taken from the stack 1 and erected. The inclination sensor 16 switches on the power supply and thus supplies the electronics unit 15 and the radio modules 17, 19 with standby current. As a result, the state of the linkage changes into the READY mode. The linkage 4 is transported to the drilling location. In consequence, the inclination sensor 16 is used as switch for the supply of power to the electronics unit 15 and the radio modules 17, 19, the power supply being switched off with an approximately horizontal attitude of the linkage 10 and being switched on with an approximately vertical operation or already when leaving the horizontal attitude from the sleep mode of the power supply for the electronics unit 15 and the radio modules 17, 19.

Figure 3:
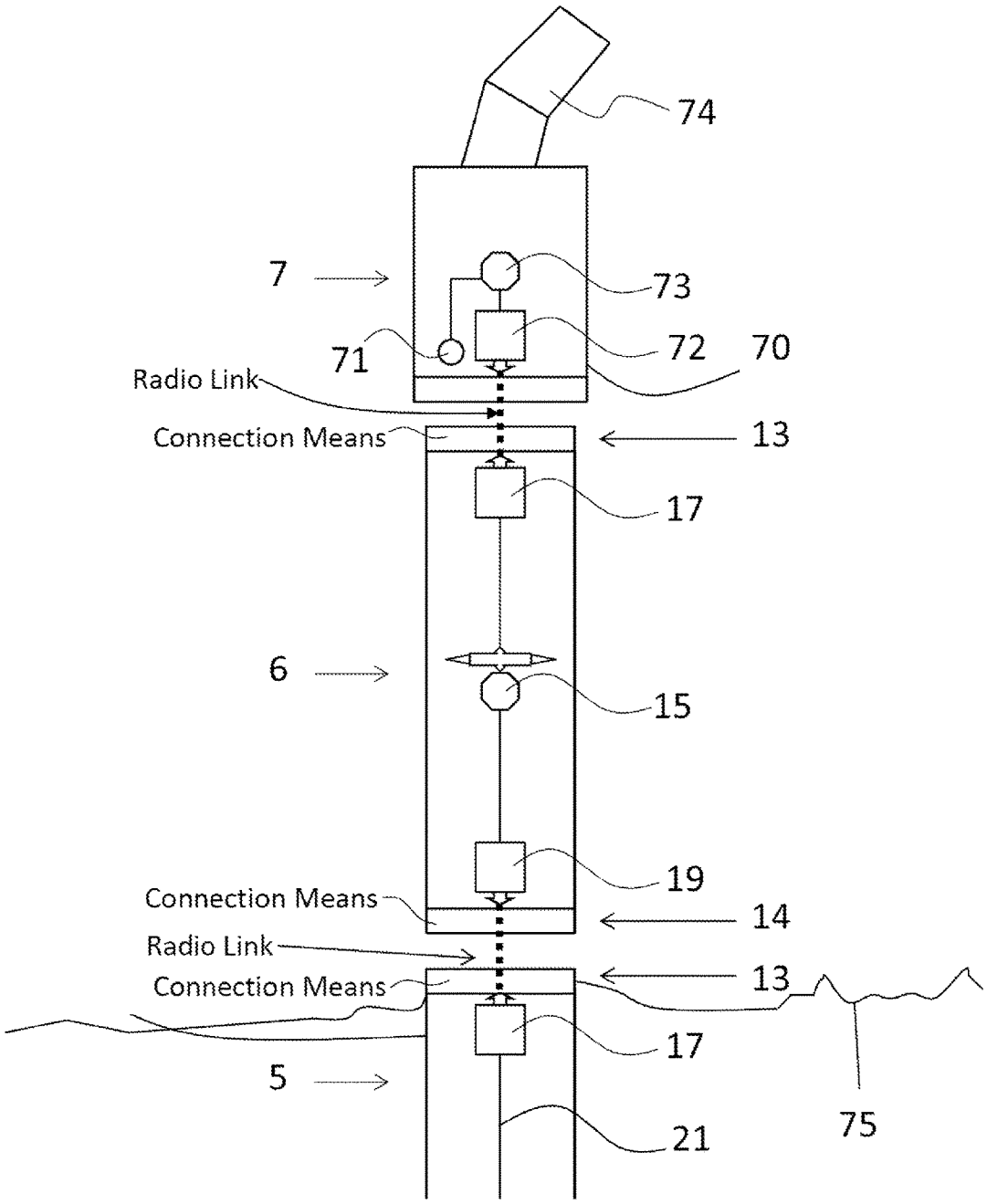
FIG. 3 shows mounting linkages between drilling string and kelly, or SET mode.

According to FIG. 3, a further operation follows in which the (n+1)-th linkage 6 taken from the stack 1 is mounted between the topmost n-th linkage 5 of the drilling string and the clamping/griping jaw 70 of a drill drive 7. In the SET mode, the prepared 'new' (n+1)-th linkage 6, which is in sleep mode, is transported to the topmost n-th linkage 5 of the drilling string, which, in the meantime, has been freed of clamping/gripping jaw 70 and the kelly rod 74 and is placed down with its first lower end 14 and mechanically rigidly screwed together with its upper end 13. Following this, the kelly rod 74 of the drill drive 7 of the drilling device is placed onto the second upper end 13 of the 'new' linkage 6 and also mechanically rigidly screwed together with it via the clamping/gripping jaw 70.

In a further advantageous embodiment, a proximity sensor 71 is activated in the head of the kelly rod 74 when the kelly rod 74 of drill drive 7 is placed onto the second upper end 13 of the 'new' linkage 6, which sensor causes a radio frequency identification (RFID) reader via a transceiver 72 to interrogate the identifier (ID) of the transceiver 17 opposite it of the second upper end 13 of the linkage 6. By means of this procedure, the identifier of the electronics unit 73 arranged in the drill drive 7, which also has a microcontroller, is sent to the surface computer 100 which is in direct radio connection with the drill drive 7 and which again performs a synchronization of all data in such a manner that the new linkage 6 forms a new node within the drilling string ad-hoc network.

Figure 4:
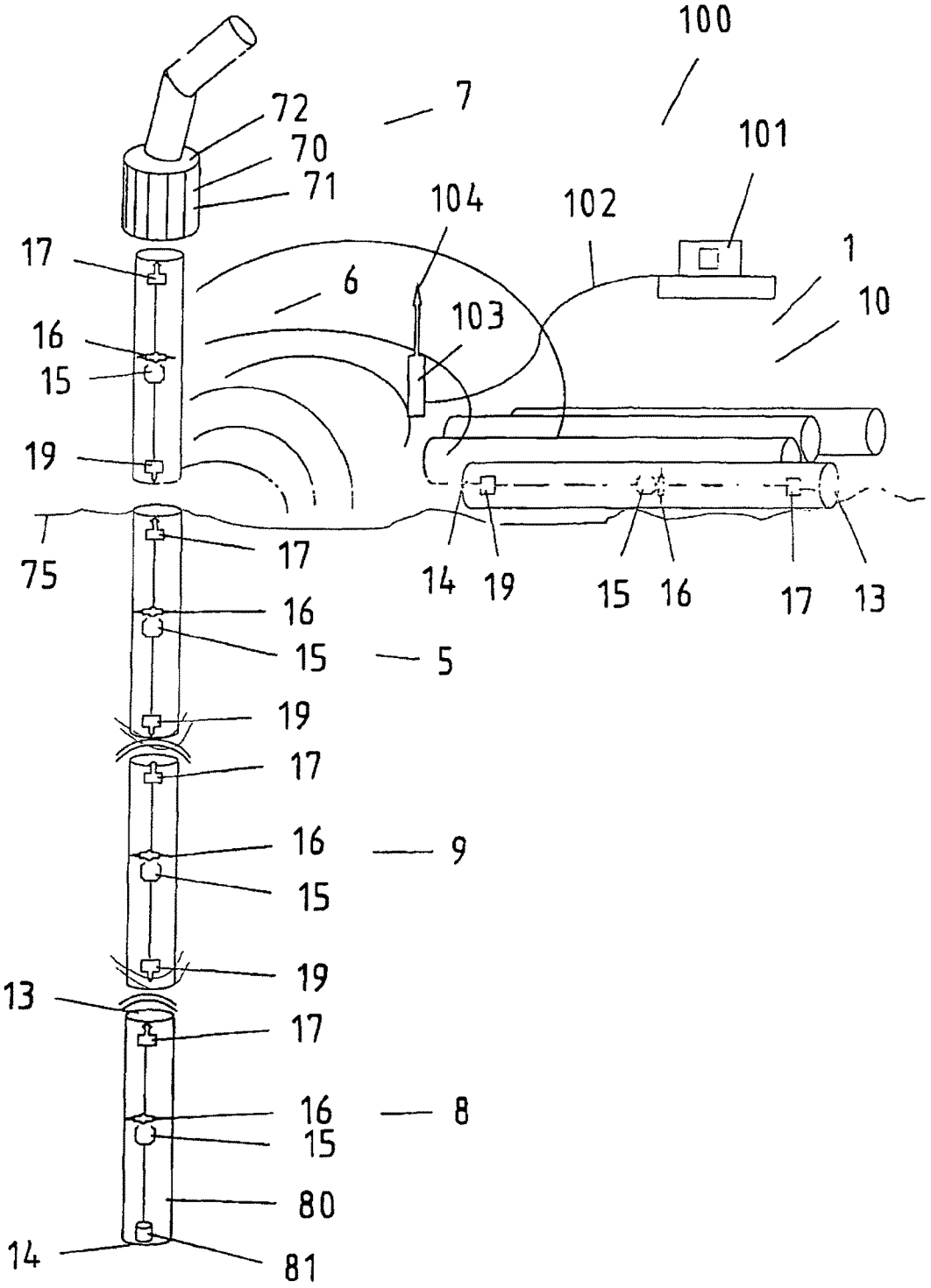
FIG. 4 shows active principle of the overall drilling string/linkage arrangement.

FIG. 4 shows the active principle of the overall drilling string-linkage arrangement. On the right-hand side, the storage location 1 for the wired drilling rod linkages 10 is shown in REST mode whilst the left-hand side shows linkages 5, 6, 8, 9 of a drill string from bore hole bottom to earth surface 75 with drill drive 7 and surface computer 100. The linkages 5, 6, 9, 10 are here represented as 'standard' linkages, the linkage 8 is the first linkage of the drilling string and is located at the bore hole bottom. The drilling rod linkages 8, 80 have a receptacle for a drill head and in its vicinity sensors 81 with various measuring devices, particularly sensors such as inclinometer, deflectometer, plumb line meter or inclinometer for the perpendicular drilling and, if necessary, an actuator or several actuators 81.

The linkage head ends 13, 14 are in each case equipped with a radio-controlled commercially available transmitter and/or receiver or transceiver 17, 19 which are fed via the rechargeable storing power supply and are arranged in such a manner that a transmitter 17 is located in unidirectional transmitting direction from the bore hole bottom to the earth surface 75 at the upper end 13 of the n-th linkage 5 and a receiver 19 is located at the lower end 14 of the following (n+1)-th linkage 6. For unidirectional operation, it then applies for a transmitting direction from the earth surface 75 to the bore hole bottom that a transmitter 19 is located at the lower end 14 of the (n+1)-th linkage 6 and a receiver 17 is located at the upper end 13 of the following n-th linkage. If the data transmission is set up only in one unidirectional direction, the linkages 10 do not have identical equipment at the upper end 13 and the lower end 14 and must be stored direct-oriented. If the linkages 10 are designed for bidirectional data transmission and equipped with combined transceivers 17, 19 at the ends, the attitude-related directional orientation is omitted.

The data transmission is unidirectional or bidirectional beginning, for example, at the sensor devices 81 of the drilling rod linkage 80, is always conducted via the wiring from one end 14 of the linkage to the other end 13 in all WDP linkages 10 and at the drilling rod linkage joints, in most cases constructed as screw fittings, transmitted via at least one transmitter and/or receiver or combined transceivers 17, 19 from one drilling rod linkage to the next drilling rod linkage reliably over a very short distance. Environmental influences having a negative effect on the quality of the wireless transmission do not occur. The wireless message transmission is restricted to the transmission path from one upper end 13 of a linkage n to the lower end 14 of the adjacent linkage n+1 to approximately 30 cm to 40 cm with an arrangement which is always identical and an environment which is always identical.

Electronics unit 15 and radio modules 17, 19 of a drilling rod linkage 10 are a component of an ad-hoc network. The drill drive 7 is also equipped with an electronics unit 73 with microcontroller and a radio module 72 as second, top end of the drilling string and exchanges information with the adjacent (n+1)-th drilling rod linkage 6 changing with the advance of drilling/milling. Communication between the drill drive 7 and the surface computer 100, 101 takes place via a radio link, the line 102 connecting a radio module 103 with radio antenna 104 durably to the surface computer 100, 101. The surface computer 100, 101 incorporates the entire drilling site organization and administration as well as the drilling string measurement data acquisition and evaluation and the linkage administration and network organization.

Figure 5:
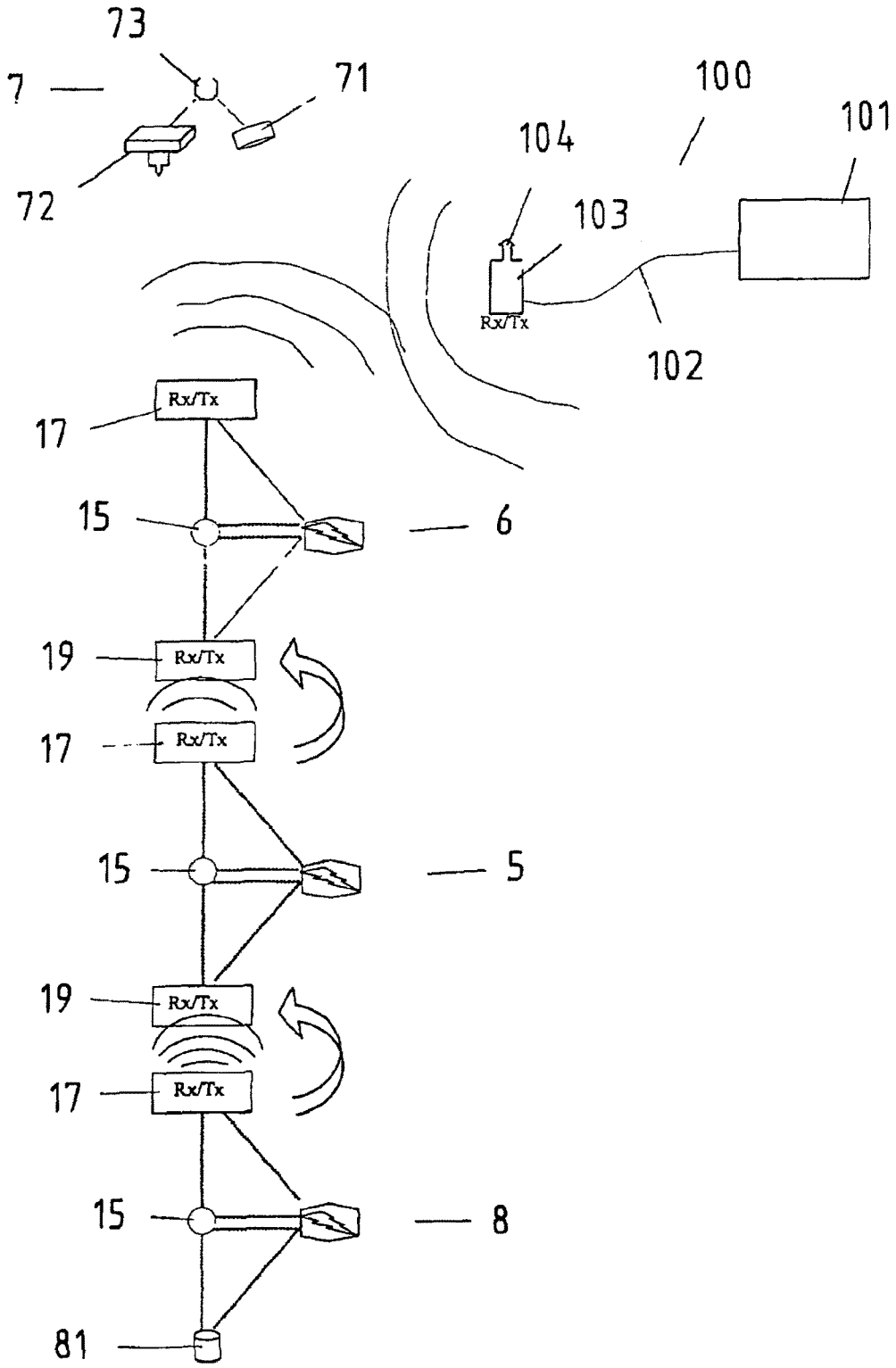
FIG. 5 shows drilling rod linkages as node in the drilling string ad-hoc network.
Figure 6:
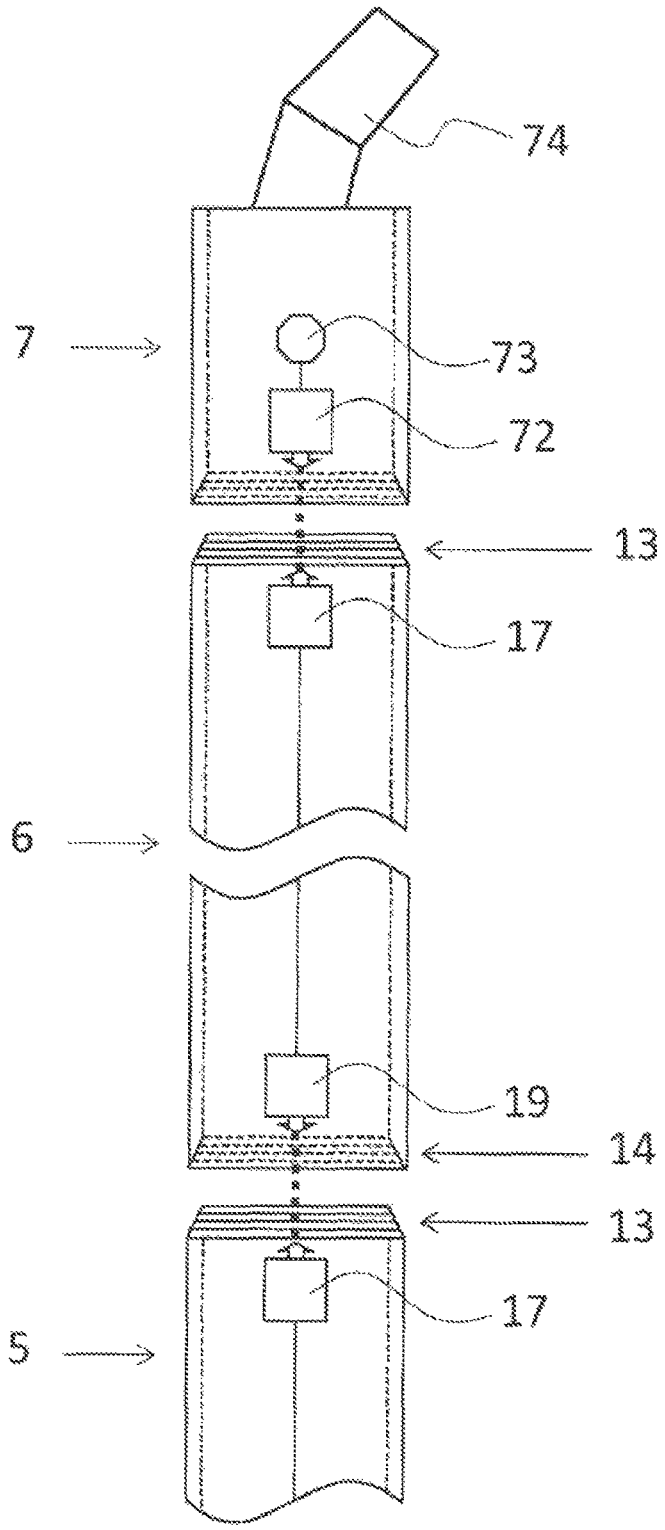
FIG. 6 shows mounting linkages between drilling string and Kelly.

FIG. 5 shows the drill rod linkages 10 as nodes in the drilling string ad-hoc network with the example of a drilling string having three drilling rod linkages 5, 6, 8. The drilling information, which is acquired from the measurement data of the sensors 81 of the linkage 8 during the operation, is supplied via the drilling rod electrical linkage line 21 to the transmitter 17 of the lowermost drilling rod linkage 80 ($n-1$) and transferred to the receiver 19 of the drilling rod linkage 5 (*n*) above them and furthermore to the upper linkages 6 (*n*+1) and via the radio module 72 and the electronics unit 73 in the drive 7 to the surface computer 100, 101. All participants of this information chain are nodes in the drilling string ad-hoc network which consists of the permanent participants "surface computer 100" and "drive 7" and the changing participants "drilling rod linkages" 8, 5, 6 which have become nodes of the ad-hoc network in a self-learning and administration process according to the method described above. The drilling string network administration is also a software component of the surface computer.

The communication system according to the present invention has a communication power with respect to data rate and data quality which is independent of the depth of the bore hole. Its use is also possible in the most difficult soil conditions and in water. Furthermore, the communication functions just as well with 1000-m-deep bore holes as with a depth of 10 m.

The present invention is not limited to embodiments described herein; reference should be had to the appended claims.

LIST OF REFERENCE DESIGNATIONS

1 Drilling rod linkage, stacked, REST mode
3 Drilling rod linkage, removed, erected, READY mode
4 Drilling rod linkage, transported, READY mode
5 Drilling rod linkage n, node n
6 Drilling linkage n+1, SET mode, node n+1
7 Drill drive with receptacle
8 Drilling rod linkage, node
9 Drilling rod linkage n−1, node n−1
10 Drilling rod linkage, wired drill pipe (WDP)
11 Drill pipe
12 Wall thickness
13 Upper end
14 Lower end
15 Electronics unit and power supply, node
16 Inclination sensor
17 Upper communication unit (transceiver/transmitter/receiver/radio module)
18 Radio antenna 1
19 Lower communication unit (transceiver/transmitter/receiver/radio module)
20 Radio antenna 2
21,22 Electrical line, single-/multi-pair
70 Clamping/gripping jaw
71 Proximity sensor with RFID reader
72 Communication unit (transceiver/radio module)
73 Electronics unit, node drive
74 Kelly rod
75 Earth's surface
80 Drilling rod linkage with drill head/bit receptacle
81 Actuators, sensors
100 Surface computer
101 Drilling site computer, node computer
102 Cabling
103 Communication unit (radio module)
104 Radio antenna

What is claimed is:

1. A communication system for transmitting information via drilling rod linkages of a drilling string for earth drillings, the communication system comprising:

a drill drive;

drilling rod linkages comprising a first drilling rod linkage and at least one second drilling rod linkage, the first drilling rod linkage being formed from a hollow, cylindrical drill pipe comprising at least one electrical line extending in an axial direction, an upper end and a lower end, the lower end of the first drilling rod linkage comprising a receptacle for a drill head, the at least one second drilling rod linkage being formed from a hollow, cylindrical drill pipe comprising at least one electrical line extending in an axial direction, an upper end and a lower end, wherein each of the at least one second drilling rod linkage is connected in a rotationally fixed manner via the lower end to the upper end of the first drilling rod linkage or to the upper end of another second drilling rod linkage, and is connected in a rotationally fixed manner via the upper end to the lower end of a further second drilling rod linkage or to the drill drive, at least one of a sensor and an actuator arranged at least at the lower end of the first drilling rod linkage or at the drill head, the at least one of a sensor and an actuator being configured to transmit data which includes at least one of measurement data, parameterizing data, status data and control data;

a first communication unit and an electronics unit arranged longitudinally outside an area of a connecting means arranged at a drive end, at or in the drill drive, the first communication unit and the electronics unit being connected to each other;

a surface computer configured to monitor an earth drilling, the surface computer being communicatively connected to the electronics unit at the drive end and being configured to receive or to provide the data of the at least one of a sensor and an actuator;

further communication units, at least one of the further communication units being arranged longitudinally outside the area of a connecting means arranged at the upper end of the first drilling rod linkage, and at least one of the further communication units being arranged longitudinally outside the area of a connecting means arranged at the upper end and longitudinally outside the area of a connecting means arranged at the lower end of the at least one second drilling rod linkage, respectively, at least one electronics unit comprising a microcontroller, the at least one electronics unit being arranged in each drilling rod linkage; and at least one power supply for the further communication units and for the at least one electronics unit arranged in each drilling rod linkage, wherein, the at least one of a sensor and an actuator and the at least one further communication unit arranged longitudinally outside the area of the connecting means arranged at the upper end of the first drilling rod linkage are connected to one another via the at least one electrical line, the at least one electronics unit of the first drilling rod linkage is arranged between the at least one of a sensor and an actuator and one of the further communication units of the first drilling rod linkage with respect to the data, the further communication units of each second drilling rod linkage are connected to one another via their respective at least one electrical line, the electronics unit of the respective second drilling rod linkage being located between the further communication units with respect to the data, the first communication unit and the further communication units are each radio modules, and are each configured to at least one of transmit data to and to receive the data from at least one of an immediately adjacent further communication unit of a next drilling rod linkage or from the drill drive, and when the at least one second drilling rod linkage is connected to the first drilling rod linkage or to the another second drilling rod linkage, and the at least one second drilling rod linkage is connected to the drill drive or to the further second drilling rod linkage, the first communication unit and each further communication unit is arranged so that a radio link exists having a distance which is at least equal to a distance of the connecting means in a longitudinal direction.

2. The communication system as recited in claim 1, wherein each of the drilling rod linkage further comprises an unambiguous identifier through which each respective drilling rod linkage is identifiable.

3. The communication system as recited in claim 1, wherein each respective drilling rod linkage forms a node in an ad-hoc network.

4. The communication system as recited in claim 2, wherein the unambiguous identifier is stored in at least one of the electronics unit and in at least one of the further communication units, the unambiguous identifier being configured so as to be queried by the first communication unit at the drive end.

5. The communication system as recited in claim 2, wherein each respective drilling rod linkage further comprises an RFID transponder configured to store the unambiguous identifier.

6. The communication system as recited in claim 5, wherein the drill drive comprises a proximity sensor with an RFID reader connected to the electronics unit at the drive end, the RFID reader being configured to activate the RFID transponder of the respective drilling rod linkage so as to transmit the unambiguous identifier.

7. The communication system as recited in claim 5, wherein the RFID transponder is an active RFID transponder connected to the at least one power supply, the active RFID transponder being configured to switch on the at least one power supply upon receipt of an activation signal.

8. The communication system as recited in claim 1, wherein the further communication units are configured to transmit the data by WLAN.

9. A drilling rod linkage for a drilling string for earth drillings for establishing a communication system as recited in claim 1, wherein the drilling rod linkage consists of:

the first drilling rod linkage as recited in claim 1, or the at least one second drilling rod linkage as recited in claim 1.

10. The drilling rod linkage as recited in claim 9, wherein at least one of the further communication units in a) or the communication unit in b) is a combined transmission/receiver unit (transceiver).

11. The drilling rod linkage as recited in claim 9, further comprising an inclination sensor arranged in the hollow-cylindrical drill pipe, the inclination sensor being configured to detect a position of the drilling rod linkage.

12. The drilling rod linkage as recited in claim 11, wherein the inclination sensor is connected to the at least one power supply and is configured to switch on the at least one power supply for the electronics unit and for at least one of the further communication units in a) and the communication unit in b) when the drilling rod linkage is transitioned from a horizontal position to a vertical position, and for switching off the at least one power supply for the electronics unit and for at least one of the further communication units in a) and the communication unit in b) when the drilling rod linkage is transitioned from the vertical position to the horizontal position.

13. The drilling rod linkage as recited in claim 12, wherein the at least one power supply is attached so as to be removable at or in the drill pipe (11).

14. The drilling rod linkage as recited in claim 13, wherein the at least one power supply is attached via a plug.

15. The drilling rod linkage as recited in claim 9, wherein the at least one power supply is configured to be switchable.

16. The drilling rod linkage as recited in claim 14, wherein the drill pipe comprises at least one recess, such as a pocket-shaped recess, the at least one recess being configured to accommodate and protect at least one of the at least one power supply, the electronics unit, the further communication units in a), and the communication unit in b).

17. The drilling rod linkage as recited in claim 16, wherein the plug is arranged in the at least one recess and is configured to establish an electrical plug-in contact with at least one of the at least one power supply, the electronics unit, the further communication units in a), and the communication unit in b).

18. The drilling rod linkage as recited in claim 9, wherein the at least one power supply is provided from at least one battery.

19. The drilling rod linkage as recited in claim 9, wherein the at least one power supply is rechargeable.

20. The drilling rod linkage as recited in claim 9, wherein the drill pipe comprises an automatically recharging device configured to automatically recharge the at least one power supply during an operation of the drilling rod linkage.

21. The drilling rod linkage as recited in claim 9, wherein the at least one power supply has at least one of a visual device and an audible device configured to indicate at least one of a charging state, a residual capacity and a still-available power supply period.

22. The drilling rod linkage as recited in claim 9, wherein the at least one power supply and the electronics unit form one constructional unit.

23. The drilling rod linkage as recited in claim 9, wherein each of the respective further communication units in a) and the communication unit in b) further comprises the electronics unit, and wherein the electronics unit (15) forms one constructional unit with the respective further communication units in a) and the communication unit in b).

24. The drilling rod linkage as recited in claim 9, wherein each of the respective further communication units in a) and the communication unit in b) further comprises the at least one power supply, and wherein the at least one power supply forms one constructional unit with the respective further communication units in a) and the communication unit in b).

25. The drilling rod linkage as recited in claim 9, wherein at least one of the electronics unit and the at least one power supply is arranged in an axial center of the drill pipe.

26. The drilling rod linkage as recited in claim 9, wherein the respective further communication units in a) or the communication unit in b) further comprises a housing, the hosing being configured to mount the respective further communication units in a) or the communication unit in b) on an outside of the drill pipe.

27. The drilling rod linkage as recited in claim 26, wherein the housing comprises an opening configured to be closed by a non-metallic material, the opening being oriented in a direction of the outer upper edge of the upper end or the lower outer end at which the respective further communication units in a) or the communication unit in b) is arranged.

28. The drilling rod linkage as recited in claim 16, wherein the at least one recess comprises an opening configured to be closed by a non-metallic material, the at least one recess being oriented in a direction of an outer edge of the upper end or the lower end at which the respective further communication units in a) or the communication unit in b) is arranged.

29. The drilling rod linkage as recited in claim 9, wherein the at least one of a sensor and an actuator is a sensor connected to the electronics unit.

30. The drilling rod linkage as recited in claim 29, wherein the sensor is at least one of a pressure sensor and a temperature sensor.

31. The drilling rod linkage as recited in claim 9, wherein the at least one of a sensor and an actuator is an actuator connected to the electronics unit.

32. The drilling rod linkage as recited in claim 31, wherein the actuator is at least one of a valve, a motor and a pump.

33. The drilling rod linkage as recited in claim 9, wherein the respective further communication units in a) or the communication unit in b) is arranged at a distance of between 15 cm and 20 cm before an edge of an end of the respective upper end (13) or the lower end (14) of the drill pipe (11).

34. The drilling rod linkage as recited in claim 9, wherein the respective further communication units in a) or the communication unit in b) is configured to provide for a near-field communication with a transmission range of less than 1 m.

35. The drilling rod linkage as recited in claim 34, wherein the transmission range is between 30 and 50 cm.

36. The drilling rod linkage as recited in claim 9, wherein the at least one electrical line is a single-paired electrical line or a multi-paired paired electrical line.

37. A drilling string for performing earth drillings, the drilling string consisting of:

the first drilling rod linkage as recited in claim 1; and at least one of the at least one second drilling rod linkage as recited in claim 1.

* * * * *